US009309072B2

(12) United States Patent
Pearce et al.

(10) Patent No.: US 9,309,072 B2
(45) Date of Patent: Apr. 12, 2016

(54) IDLER ROLL WITH RETARD SPIN FUNCTION

(71) Applicant: Xerox Corporation, Norwalk, CT (US)

(72) Inventors: Christopher Pearce, Hertfordshire (GB); Jeffrey W Ryan, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/293,147

(22) Filed: Jun. 2, 2014

(65) Prior Publication Data

US 2015/0343815 A1 Dec. 3, 2015

(51) Int. Cl.

| | |
|---|---|
| ***B65H 5/06*** | (2006.01) |
| ***B41J 29/10*** | (2006.01) |
| ***B65H 27/00*** | (2006.01) |
| ***B65H 5/00*** | (2006.01) |

(52) U.S. Cl.

CPC ..... *B65H 5/068* (2013.01); *B41J 29/10* (2013.01); *B65H 5/00* (2013.01); *B65H 27/00* (2013.01); *B65H 2404/1118* (2013.01); *B65H 2404/1119* (2013.01); *B65H 2404/1122* (2013.01); *B65H 2404/13163* (2013.01); *B65H 2404/56* (2013.01); *B65H 2601/521* (2013.01); *Y10T 29/49545* (2015.01)

(58) Field of Classification Search

CPC ..... B65H 5/068; B65H 2601/125; B65H 2601/521; B65H 2404/1118; B65H 2404/1119; B65H 2404/1122; B65H 2404/113; B65H 2404/13163; B65H 2404/1316; B65H 2404/13171; B65H 2404/1321; B65H 2404/192; B65H 2404/1371; B65H 2404/1374; B65H 2404/56; B65H 2515/82; B65H 2404/1313; B65H 2404/1314; B65H 2404/1341; B65H 2404/1347; B65H 27/00; B41J 29/10

USPC ..... 492/33

See application file for complete search history.

(56) References Cited

U.S. PATENT DOCUMENTS

| | | | | |
|---|---|---|---|---|
| 4,126,305 | A * | 11/1978 | Colglazier | B65H 3/0669 271/120 |
| 6,857,631 | B2 | 2/2005 | Morrison et al. | |
| 2008/0258382 | A1 * | 10/2008 | deJong et al. | 271/265.02 |
| 2010/0090390 | A1 | 4/2010 | Urban et al. | |

* cited by examiner

*Primary Examiner* — Michael McCullough

(57) ABSTRACT

A method and apparatus for preventing excess spin of idler rollers after a sheet of paper or other media has passed a media guide with the idler rollers including a retard function within plastic idler rollers. The retard function is provided by adding a retard flexure molded into the idler roller. This adds a brake which stops excess over spin of the idler rollers.

7 Claims, 2 Drawing Sheets

IDLER ROLL WITH RETARD SPIN FUNCTION

The present apparatus and method relates to noise reduction in a printer, and more particularly, to audible noise caused by unnecessary spinning of idler rollers after media has left the rollers.

In a typical printer, media trays store media sheets within the printer. During the printing cycle, a media transport system retrieves media sheets from a tray, routes the media through the printer to receive an image, and then ejects the media into an output tray for collection by a user. The media transport system utilizes drive rollers and idler rollers to transport media through the printing process. Drive rollers are fixedly mounted about shafts that are coupled to the rotational output of an electrical motor or other actuator. As the shafts rotate in response to the rotational output of a motor, the drive rollers rotate. Idler rollers are mounted for rotation about an idler shaft that is engaged to a printer surface. Typically, the idler rollers are positioned opposite drive rollers. As the drive rollers rotate, they frictionally engages the idler rollers sufficiently to rotate the idler rollers. As a media sheet contacts a drive roller and idler roller junction or nip, the rotating rollers propel the sheet through the media path. Thus, the idler rollers assist in the movement of media sheets through the printer without requiring additional actuators for their rotation. Additionally, in some printers, idler rollers are used to ease media passage, e.g., around a paper tray output guide during feeding from a paper tray. Idler rollers in this instance do not have an opposing drive rollers, thus allowing them to spin freely after media has passed and create unwanted noise.

Heretofore, various vibration and noise reduction methods have been employed in printers. For example, US Patent Publication No. 2010/0090390 A1 discloses an apparatus for transporting media in a printer that helps reduce vibration and noise in the printer. The apparatus includes a pair of brackets secured to a printer surface, a shaft, a first portion of the shaft being secured within one of the brackets and a second portion of the shaft being secured within the other bracket, a roller mounted about the shaft for rotation about the shaft, and a pair of vibration dampers, one vibration damper interposed between the first portion of the shaft and the one bracket, and the other vibration damper being interposed between the second portion of the shaft and the other bracket.

U.S. Pat. No. 6,857,631 discloses a sheet feeding system in which idler roller shafts are loosely mounted between opposing side walls of a slot for limited movement relative to their mating sheet feeding rollers, and spring biased there towards to provide sheet feeding nips with the desired normal force, wherein the spring biasing is non-symmetrical to additionally provide orthogonal spring biasing of the idler shafts towards only one of the side walls of their mounting slot. This non-symmetrical spring biasing may be provided by a torsion spring with a central coil wrapper around the idler shaft with extending legs anchored in non-symmetrical anchoring position and/or with non-symmetrically shaped legs.

The heretofore cited patent and publication are included herein by reference to the extent necessary to practice the present disclosure.

Unfortunately, even though the vibration and noise reduction techniques of the above prior art are useful, there is still a need to reduce audible noise caused by unnecessary spinning after media has left idler rollers that ease the passage of media around a media guide without assistance from drive rollers.

BRIEF SUMMARY

In answer to that need, provided hereinafter is a method and apparatus for preventing excess spin of idler rollers after a sheet of paper or other media has passed a media guide that includes a retard function within plastic idler rollers. The retard function is provided by adding a retard flexure molded into the idler rollers. This adds a brake which stops the over spin of the rollers.

The terms 'sheet' and 'media' used herein refers to any flimsy physical sheet or paper, plastic, media, or other useable physical substrate for printing images thereon, whether pre-cut or initially web fed.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
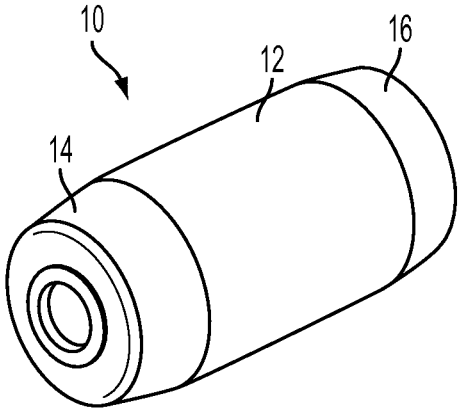
FIG. 1 PRIOR ART
FIG. 1 is a partial, perspective view of a conventional idler roller that can be used in a xerographic printer.

Referring now to prior art FIG. 1, a conventional idler roller 10 is shown which could, for example, be used in a Xerox WorkCentre 5335®. The idler roller is adapted to be mounted for rotation about a support shaft (not shown) and positioned opposite a curved sheet guide or baffle downstream of sheets to be fed from a sheet stack. These idler rollers are intended to ease media passage around a paper guide and do not have an opposing drive roll, thus allowing them to spin freely and create unwanted noise. During feeding of sheets from the stack, anti-friction paper path idler rollers 10 help the sheets around the guide, however, these idler rollers continue to spin even after the sheets have left the rollers, thus causing audible noise. Idler roller 10 includes a middle portion 12 and opposite end caps 14 and 16. The idler roller has a central opening through which a shaft is inserted for rotation about the shaft as sheets are conveyed there past.

Figure 2:
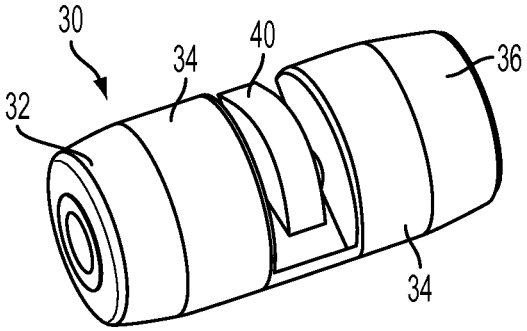
FIG. 2 is a partial, perspective view of an improved idler roller that includes the idler roller retard spin function of the present disclosure.
Figure 3:
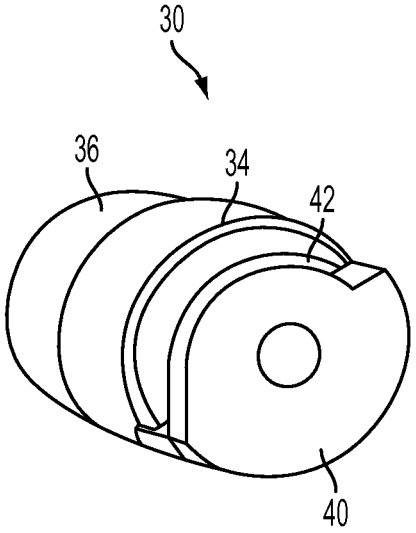
FIG. 3. Is a partial, cross-section perspective view of the improved idler roller of FIG. 2.

An improved plastic idler roller 30, in accordance with the present disclosure, is shown in FIG. 2 that includes end caps 32 and 36 that enclose a middle portion 34. Middle portion 34 includes a partially cut-out section that includes a retard member 40 that is molded into the idler roller and adds a retard flexure to the idler roller. This adds a brake which stops over spin of the idler roller after paper has left the idler roller. Retard member 40 includes a portion thereof with a reduced diameter to increase friction and stop over spin of the idler roller after media has passed. A section of improved idler roller 30 is shown in FIG. 3 which shows the reduced diameter portion 42 thereof which adds a retard flexure to the idle roller.

In recapitulation, a method and apparatus is disclosed for improving sheet noise in printers that includes molding a retard function within plastic idler rollers to prevent excess spin after a sheet of paper or other media has passed. The retard function of the idler roller is accomplished by reducing a center diameter portion of the idler rollers. This reduce diameter configuration of the idler rollers increases friction which stops over spin of the idler rollers.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device includes an idler roller, said idler roller comprising:

a first end cap;

a second end cap;

a center member connected between said first and second end caps to form said idler roller; and wherein said center member includes first, second and third portions with said second portion positioned between said first and third portions and including a peripheral portion thereof that is reduced in diameter with respect to said first and third portions and another portion thereof being semi-circular in shape, and wherein said first and third portions are in touching relationship with said first and second end caps.

2. The reprographic device of claim 1, wherein one portion of said semi-circular shape of said reduced diameter portion of said center member has a portion thereof spaced on opposite sides from other portions of said center member and connects with a flat portion of said center member.

3. The reprographic device of claim 1, wherein said center member includes at least two different radii.

4. A method for controlling spinning of an idler roller after a sheet has passed thereover, including:

providing an idler roller with a first end cap and a second end cap attached to a middle member to form said idler roller; and wherein said middle member includes opposite end portions connected to a third portion positioned between said opposite end portions, said third portion including a flat portion and portions thereof touching said opposite end portions of said middle member and a separate portion that is spaced from said opposite end portions, and wherein said opposite end portions are in touching relationship with said first and second end caps.

5. The method of claim 4, including providing said third portion with a radius that is different from a radius of said opposite end portions.

6. The method of claim 4, wherein said third portion of said middle member includes a reduced diameter portion.

7. The method of claim 6, wherein said third portion is molded into said middle member of said idler roller.

* * * * *